US006902419B2

(12) United States Patent
Conway et al.

(10) Patent No.: US 6,902,419 B2
(45) Date of Patent: Jun. 7, 2005

(54) BUS SLOT CONNECTOR RETENTION SYSTEM

(75) Inventors: Ralph W. Conway, Saratoga, CA (US); Brent W. Mosby, Fremont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/268,294

(22) Filed: Oct. 9, 2002

(65) Prior Publication Data

US 2004/0072460 A1 Apr. 15, 2004

(51) Int. Cl.[7] ..... H01R 4/50

(52) U.S. Cl. ..... 439/347

(58) Field of Search ..... 439/325, 327, 439/349

(56) References Cited

U.S. PATENT DOCUMENTS 6,375,486 B1 * 4/2002 Yu ..... 439/347

* cited by examiner

*Primary Examiner*—Ross Gushi
*Assistant Examiner*—James R. Harvey

(57) ABSTRACT

A bus slot connector. In one embodiment, a bus slot connector is comprised of a housing with a slot disposed within the housing. The slot is adapted to receive a connector portion of an adapter card. The bus slot connector is further comprised of a retention mechanism that is moveably coupled to and slidable along the housing. The retention mechanism has a lock position and an open position. The retention mechanism prevents removal of an adapter card inserted in the slot when in the lock position. The retention mechanism permits insertion of the connector portion of the adapter card into the slot and permits the removal of the connector portion of the adapter card from the slot when the retention mechanism is in the open position.

19 Claims, 11 Drawing Sheets

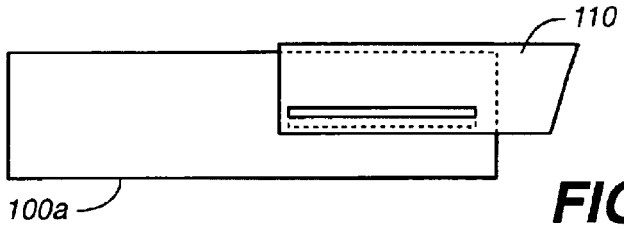
FIG._4E
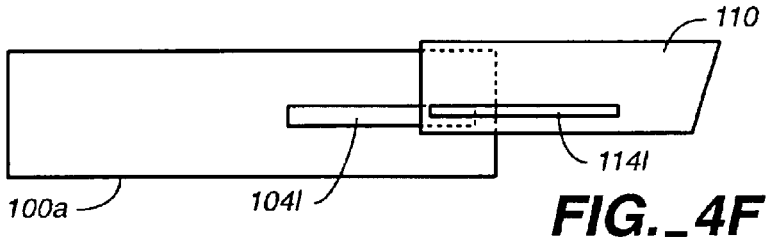
FIG._4F
FIG._4G
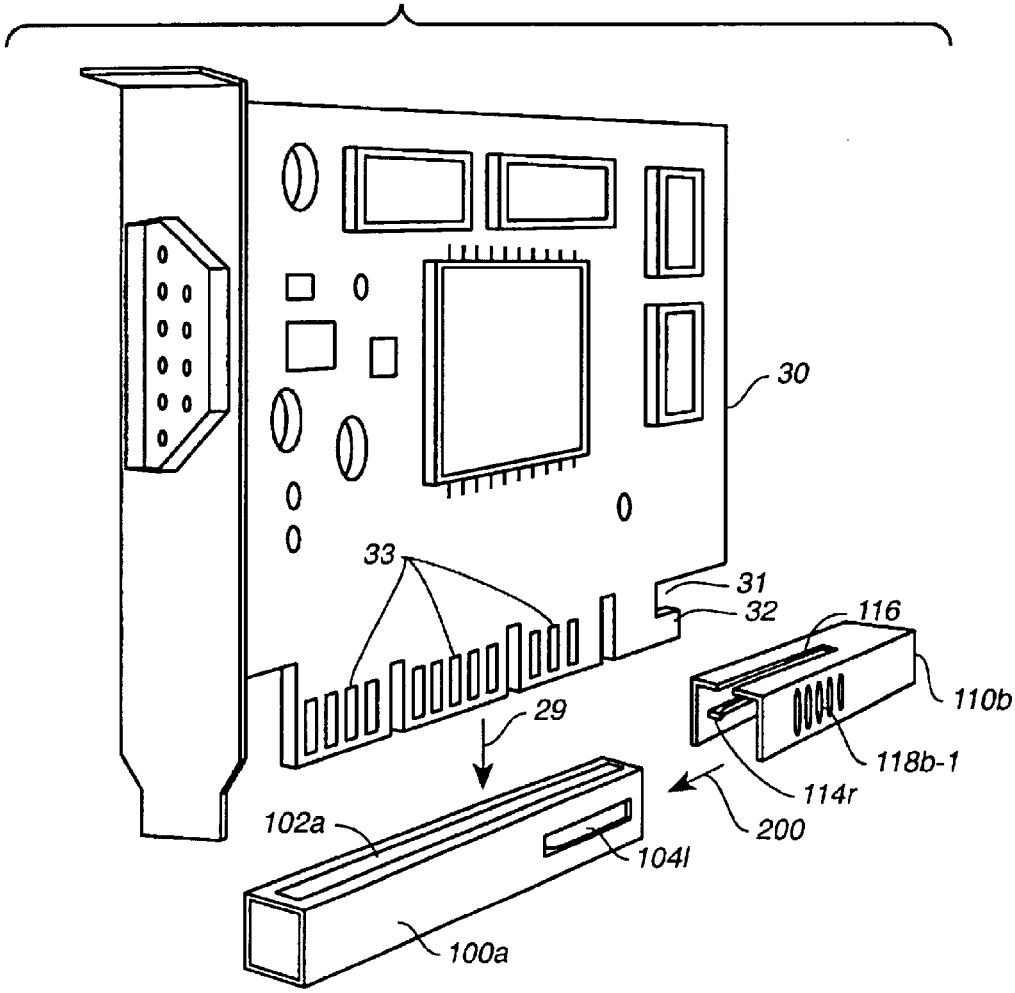

BUS SLOT CONNECTOR RETENTION SYSTEM

TECHNICAL FIELD

Embodiments of the present invention are related to providing retention of a component in a receiving slot. More particularly, the present invention provides an apparatus and method to retain a component in an inserted position within a receiving slot.

BACKGROUND ART

Currently, numerous electronic and computer companies are marketing a variety of computer system types to customers, e.g., wholesalers, retailers, and/or consumers. Types of computer systems can include, but are not limited to, desktop computer systems, workstation computer systems, server computer systems, laptop and/or portable computers, and the like.

Many of the companies that provide computer systems to consumers also assemble and provide delivery of what they are marketing. A company would receive an order for a computer system from a customer. The company would then assemble the computer system according to the specifications of the customer. Once the computer system was assembled, the system is checked for defects and proper operation, e.g., monitor and display adapter card working, keyboard functional, sound and audio adapter card functioning, OS functionality, and the like. When the computer system is deemed to be fully functional, it is common for the company to then ship the assembled computer system to the customer.

It has been observed that during transportation of a computer system to a customer, some adapter cards in the computer system, e.g., a video adapter card, a sound adapter card, a NIC (network interface card), memory, and the like, can become loosened, uncoupled, or unplugged from their original location, e.g., an bus slot connector, a memory slot connector, or an alternative slot connector, within the computer system. In many instances, the shaking and vibrations that the computer system is subjected to during shipping can loosen or dislodge the adapter card which can render the peripheral device associated with the adapter card non-functional and/or causes the intermittent and unreliable operation thereof.

FIG. 1A and FIG. 1B are each a prior art illustration of a current bus slot connector 7 (also commonly referred to as an expansion slot), e.g., a standard graphic bus slot connector 7*a* and a professional graphic bus slot connector 7*b*, respectively, configured to be communicatively coupled (soldered) with and disposed upon a printed circuit board, e.g., a motherboard 40 (FIGS. 2B, 2D), and adapted to receive an adapter card therein. In one example, graphic bus slot connector 7*a* and graphic bus slot connector 7*b* can be AGP (accelerated graphic port) connectors. In a conventional implementation, bus slot connector 7*a* may have outer dimensions of 2⅞ inches long by ⅜ inches wide and bus slot connector 7*b* may have outer dimensions of 4¼ inches long by ⅜ inches wide. The bus slot connectors shown in FIGS. 1A and 1B, e.g., connector 7*a* and connector 7*b*, are not configured with a retentive mechanism other than the friction based retention provided when an adapter card, e.g., a graphic adapter card, is inserted therein. Accordingly, when subjected to shaking and/or vibration, an adapter card inserted in a bus slot connector 7*a* or 7*b* may become loosened or dislodged, which can cause intermittent operation or failure of the peripheral device associated with the inserted adapter card.

To overcome this disadvantage, a variety of ways to prevent dislodging of adapter cards have been attempted. Prior art FIG. 2A shows a device 10 that has been utilized to prevent adapter card dislodging. Device 10 is an aftermarket device and is adapted to be implemented subsequent to insertion of an adapter card in a bus slot connector 7. Device 10 includes a left arm section 9*a* and a right arm section 8*a* and a top section 11. Arm sections 8*a* and 9*a* are shown to have at each end opposite top section 11, a hook/undercut portion 8*b* and 9*b*, respectively. Hook portions 8*b* and 9*b* are adapted to hook under the right and left sides of a bus slot connector 7*a* (or 7*b*), respectively, while arm sections 8*a* and 9*a* straddle the adapter card inserted therein, as seen in prior art FIG. 2B. Top section 11 of device 10 is slid downward to a position that holds an adapter card 30 in a bus slot connector 7*a*, while simultaneously pulling on portions 8*b* and 9*b* to provide upward force to hold hook sections 8*a* and 9*a*, respectively, under bus slot connector 7, as shown in FIG. 2B.

Disadvantageously, this attempt requires substantial dexterity on the part of the assembly worker and/or the consumer to install and use device 10 on bus slot connector 7*a*. The assembly worker and/or consumer would have to delicately and with great care place each arm section over adapter card 30 ensuring no damage occurs to adapter card 30. Further, the assembly worker and/or consumer would have to gently and carefully place hook portions 8*b* and 9*b* hook under bus slot connector 7*a*, ensuring not to cause damage to the printed circuit board, e.g., motherboard 40, upon which bus slot connector 7 is disposed. While this method to retain an adapter card in a bus slot connector may be acceptable to some assembly workers and/or some consumers, other assembly workers and/or consumers may find this method unwieldy and difficult to implement.

FIG. 2C, prior art, depicts another device to retain an adapter card in a bus slot connector. FIG. 2C shows a device 15 which has an bottom end section 17 adapted to slide under a bus slot connector 7 and an opposite top end section 16 adapted to slid down an edge surface of an adapter card 30, thus providing retention of adapter card 30 in bus slot connector 7. Analogous to device 10 of FIGS. 2A and 2B, device 15 is an aftermarket product and is designed for assembly worker and/or consumer implementation.

Disadvantageously, device 15 requires care analogous to device 10 during assembly worker and/or consumer implementation, ensuring no damage is caused to either adapter card 30 it is adapted to retain, or the printed circuit board, e.g., motherboard 40, upon which bus slot connector 7*a* is disposed. In this example, an assembly worker and/or a consumer would be required to slide bottom end section 17 under bus slot connector 7*a* while taking care to not cause damage to motherboard 40 upon which bus slot connector 7*a* is disposed. Further, the assembly worker and/or consumer would also have to slide the top end section down upon the upper edge of adapter card 30, taking care not to damage the electronics and circuitry thereon. While some assembly workers and/or some consumers may find this method adequate, other consumers may find this awkward and beyond their dexterity.

FIG. 3 is an illustrated side-view of a prior art device 33 coupled with a bus slot connector 7*b* in yet another attempt to provide retention to an adapter card 30 inserted in a bus slot connector. Bus slot connector 7*b* is adapted to receive an adapter card 30. When adapter card 30 is inserted in a receiving slot of connector 7*b*, as indicated by arrow 29, lower flange 34 of device 33 is contacted by adapter card 30, such that device 33 rotates about a hinge or axis, as indicated by arrow 36. As device 33 rotates in response to a downward force applied to adapter card 30 during insertion into bus slot connector 7*b*, upper flange 35 of device 33 interlocks with opening 31 of adapter card 30.

Disadvantageously, a force opposite to the force applied (arrow 29) to adapter card 30 for insertion can dislodge or loosen adapter card 30. Therefore, device 33 may not provide sufficient retentive properties to a bus slot connector 7*b* to ensure constant proper placement of an adapter card therewithin.

Some bus slot connectors do not provide adequate retention of adapter cards inserted therein. Additionally, some retentive mechanisms adapted for use with some bus slot connectors are not easily or readily implemented by an assembly worker and/or a consumer. Further, some retentive devices do not adequately protect against loosening and/or dislodging of an adapter card from within a bus slot connector which can cause intermittent or non-operation of the peripheral device associated with the adapter card inserted within the bus slot connector.

Disadvantageously, adapter cards that can become loosened or dislodged can contribute to customer dissatisfaction regarding product reliability as well as causing an increase in warranty liability and fiscal expense for the company that provided the computer system.

DISCLOSURE OF THE INVENTION

Thus, embodiments of the present invention are drawn to providing a bus slot connector having retentive functionality contained therewith. In one embodiment, a bus slot connector is comprised of a housing with a slot disposed within the housing. The slot is adapted to receive a connector portion of an adapter card. The bus slot connector also has a retention mechanism that is moveably coupled to and slidable along the housing. The retention mechanism has a lock position and an open position. The retention mechanism prevents removal of an adapter card inserted in the slot when in the lock position. The retention mechanism permits insertion of the connector portion of the adapter card into the slot and permits the removal of the connector portion of the adapter card from the slot when the retention mechanism is in the open position.

BRIEF DESCRIPTION OF THE DRAWINGS

The accompanying drawings, which are incorporated in and form a part of this specification, illustrate embodiments of the invention and, together with the description, serve to explain the principles of the invention.

FIG. 4E is an illustrated side view of a bus slot connector with a retention device moveably coupled therewith and with the retention device shown in a closed or locking position, in accordance with one embodiment of the present invention.

FIG. 4F is an illustrated side view of the bus slot connector and retention device of FIG. 4E with the retention device in an opened position, in accordance with one embodiment of the present invention.

FIG. 4G is an illustration of a bus slot connector with a retention device moveably coupled therewith and an adapter card that the bus slot connector is adapted to receive and retain, in accordance with one embodiment of the present invention.

BEST MODES FOR CARRYING OUT THE INVENTION

Embodiments for a bus slot connector having a retentive mechanism for retaining an adapter card inserted therein are described. Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention.

A bus slot connector is, in one embodiment, comprised of a receiving portion adapted to receive an adapter card. The bus slot connector is further comprised of a retention device that is moveably coupled therewith and slidable along the bus slot connector. The retention device has an open position, allowing an adapter card to be inserted into the receiving portion of the bus slot connector. The retention device has a locking position, preventing loosening, dislodging, or removal of an adapter card that has been inserted in the receiving portion of the bus slot connector. The retention device is easily moved from a locking position to an open position.

Advantages of embodiments of the present invention, as will be shown, below, are that when properly utilized, the retentive qualities provided by the present invention can properly retain an adapter card inserted in a bus slot connector. Another advantage is that the retentive device of the bus slot connector prevents loosening and dislodging of the adapter card, thus reducing incidences of intermittent operation or failure of the peripheral component associated with the adapter card. Additionally advantageous is that the retention device is easily and readily moveable from a locking position to an open position and vice versa.

Figure 6:
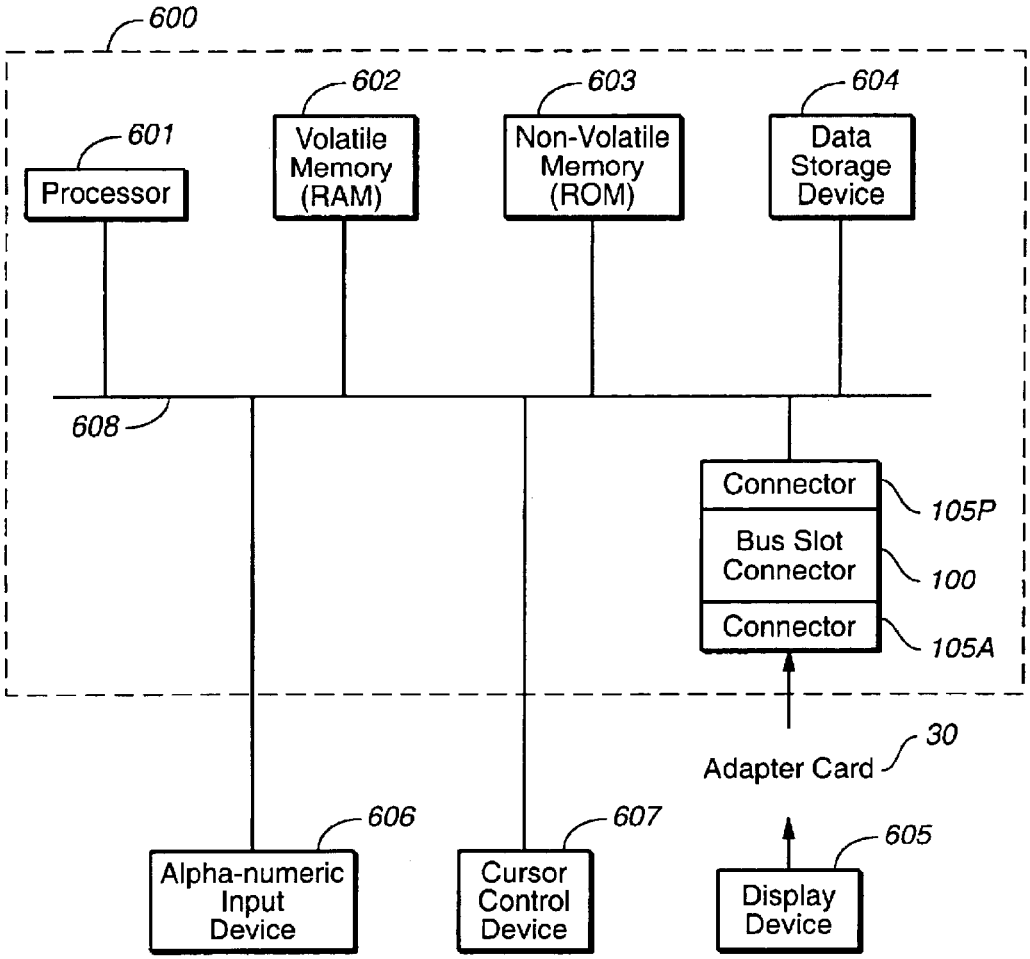
FIG. 6 is a block diagram of circuitry and components of computer system upon which embodiments of the present invention can be practiced, in accordance with one embodiment of the present invention.

Embodiments of the present invention are discussed primarily in the context of a bus slot connector which is configured to be mounted (soldered) upon and communicatively and electronically coupled to communicative and electronic pathway (bus) of a printed circuit board, e.g., a motherboard 600 of FIG. 6, and which is adapted to provide retention of an adapter card when inserted in the bus slot connector. However, it is noted that embodiments of the present invention can be utilized by other types of slot connectors to retain received alternative cards and other electronic components including, but not limited to, controller cards, memory cards, communication cards, memory devices, and many other types of cards and components whose functionalities can be detrimentally affected when insufficiently and/or improperly retained within a connector.

Figure 1A:
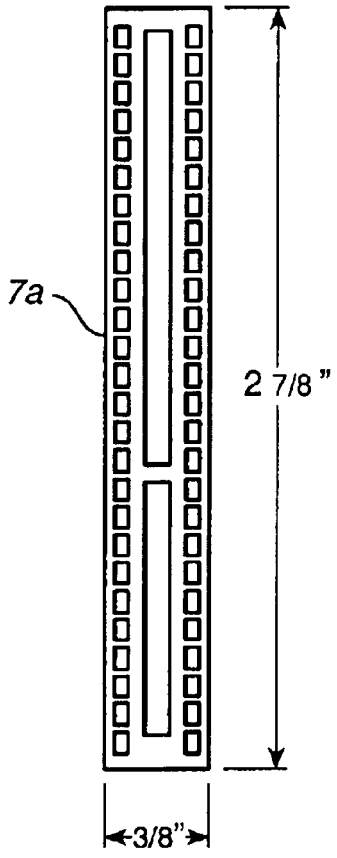
FIG. 1A (PRIOR ART)
FIG. 1A is an illustration of a prior art bus slot connector.
Figure 1B:
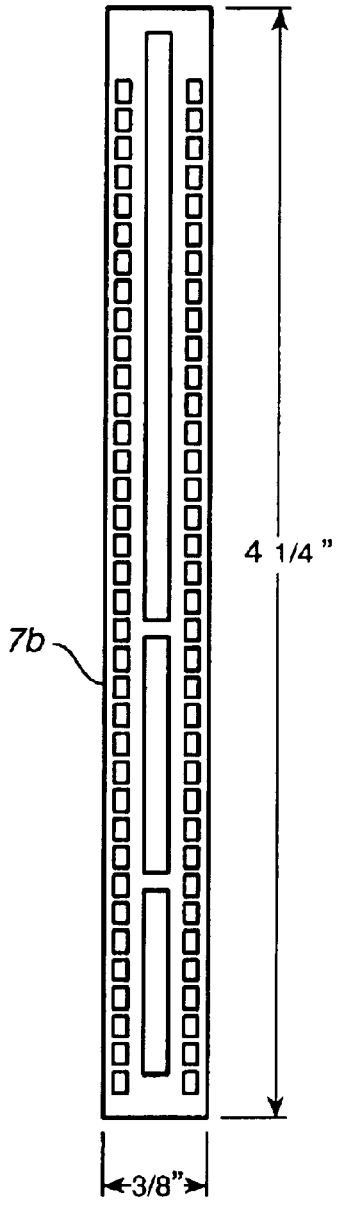
FIG. 1B (PRIOR ART)
FIG. 1B is an illustration of another prior art bus slot connector that is larger than the bus slot connector of FIG. 1A.
Figure 2A:
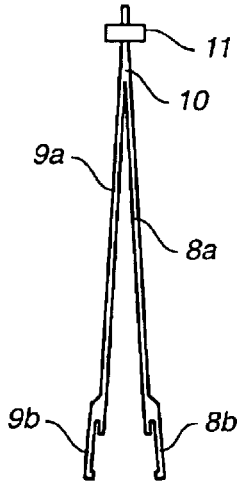
FIG. 2A (PRIOR ART)
FIG. 2A is a photograph of a prior art device for retaining an adapter card in a bus slot connector.
Figure 2B:
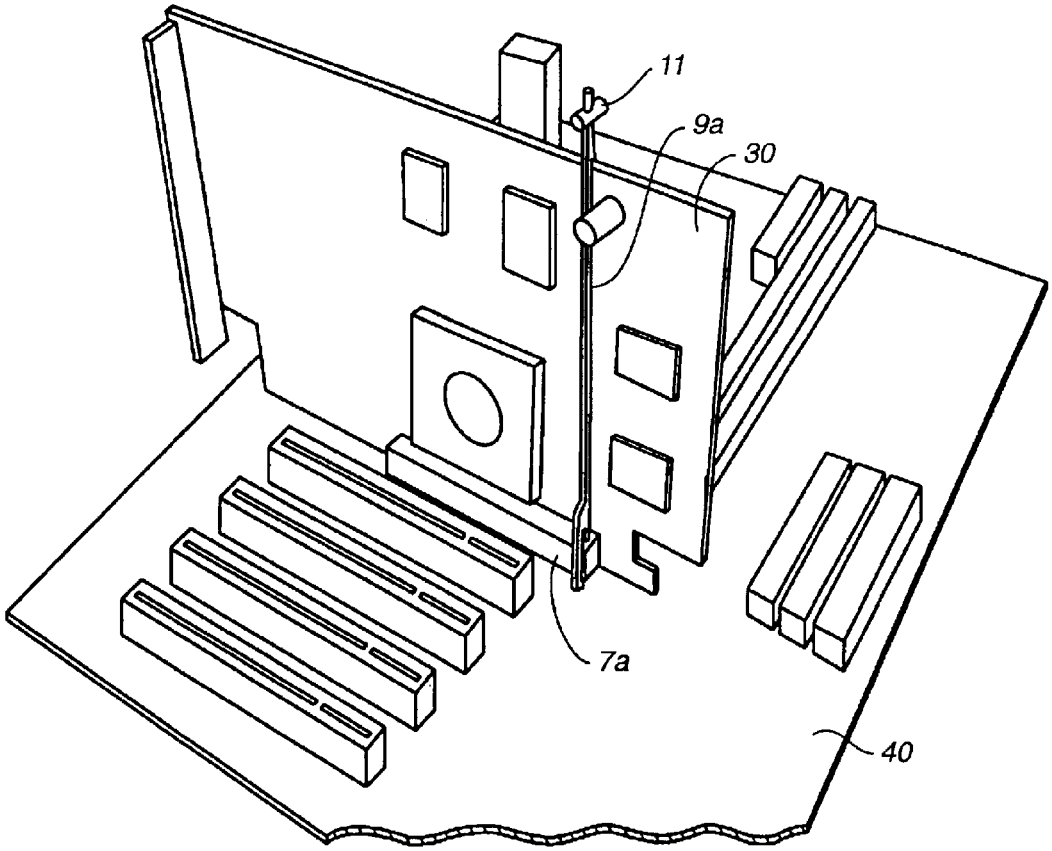
FIG. 2B (PRIOR ART)
FIG. 2B is a photograph of the prior art device of FIG. 2A implemented with a bus slot connector.
Figure 2C:
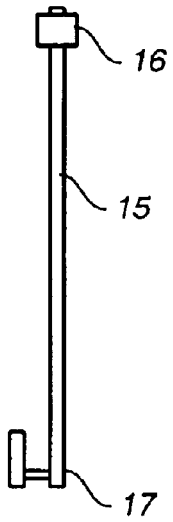
FIG. 2C (PRIOR ART)
FIG. 2C is a photograph of another prior art device for retaining an adapter card in a bus slot connector.
Figure 2D:
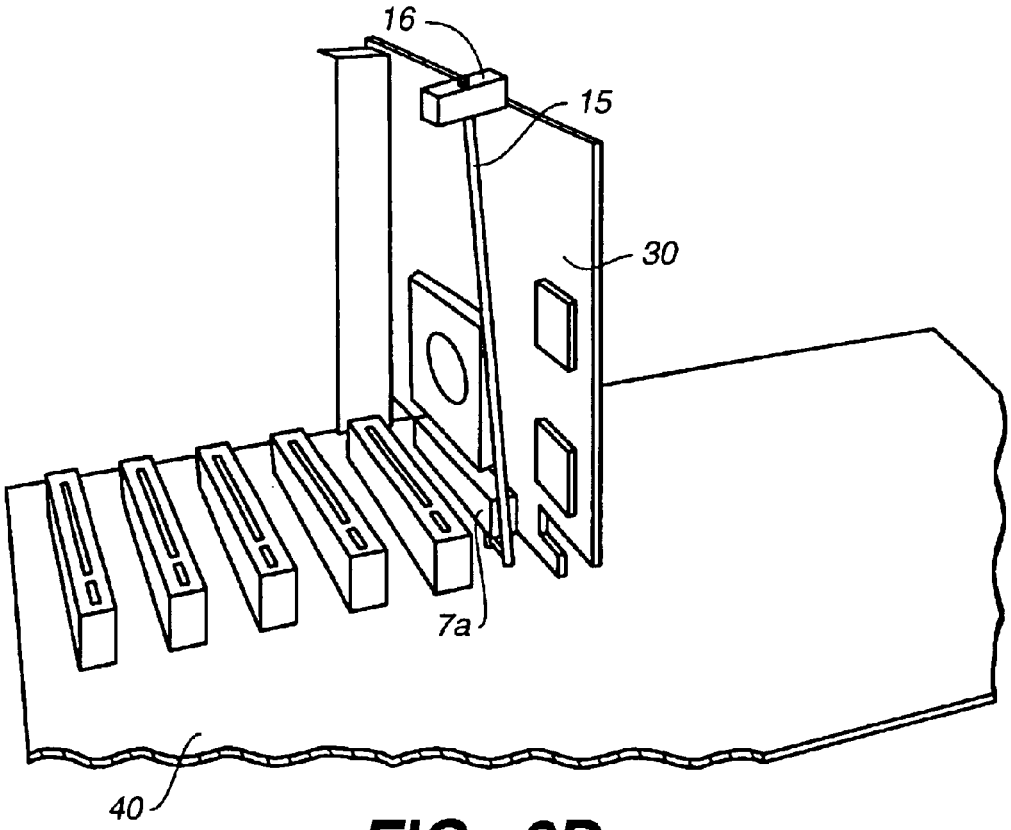
FIG. 2D (PRIOR ART)
FIG. 2D is a photograph of the prior art device of FIG. 2C implemented with a bus slot connector.
Figure 3:
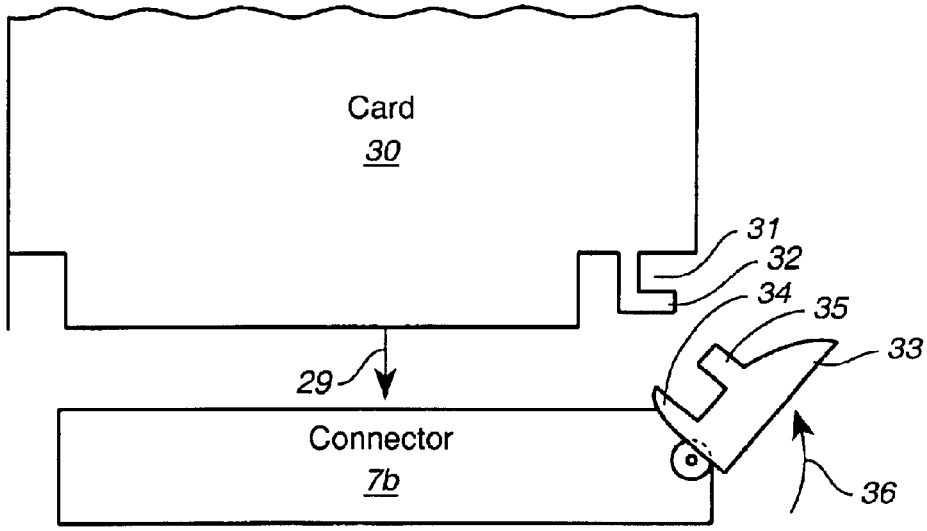
FIG. 3 (PRIOR ART)
FIG. 3 is an illustration of yet another prior art device to retain an adapter card in a bus slot connector.
Figure 4A:
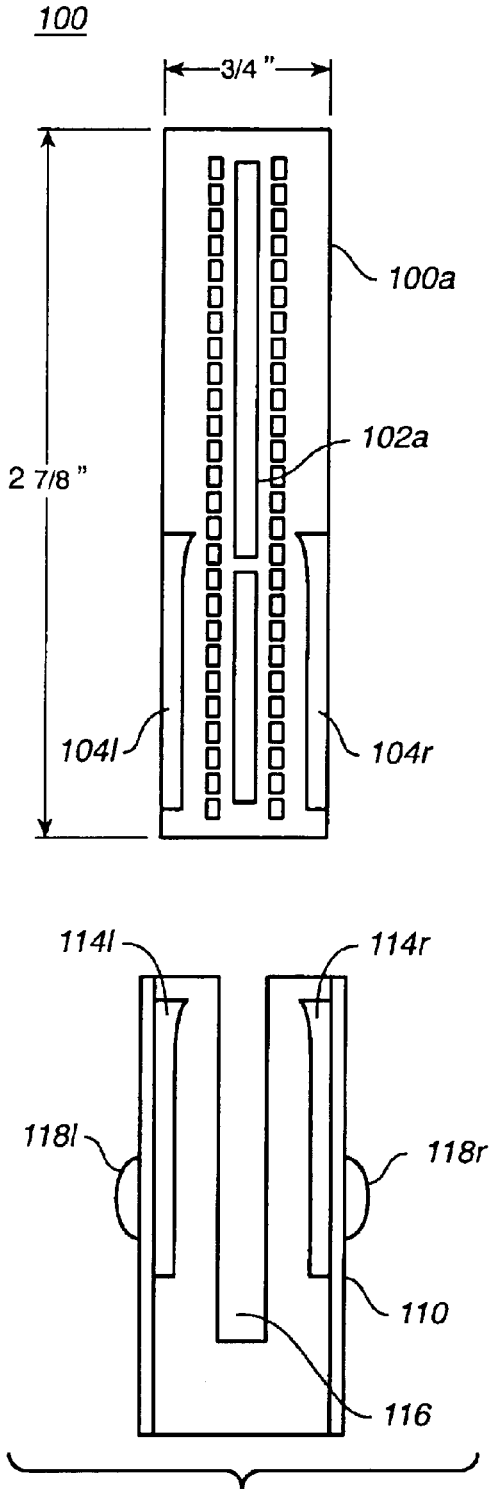
FIG. 4A is an illustration of a bus slot connector shown having a retention device moveably coupled therewith, in accordance with one embodiment of the present invention.
Figure 4B:
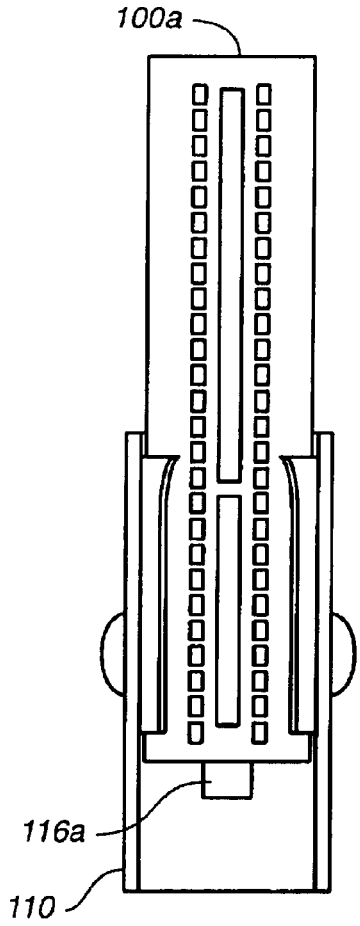
FIG. 4B is an illustration of the bus slot connector of FIG. 4A shown with the retention device in a closed or locking position, in accordance with one embodiment of the present invention.
Figure 4C:
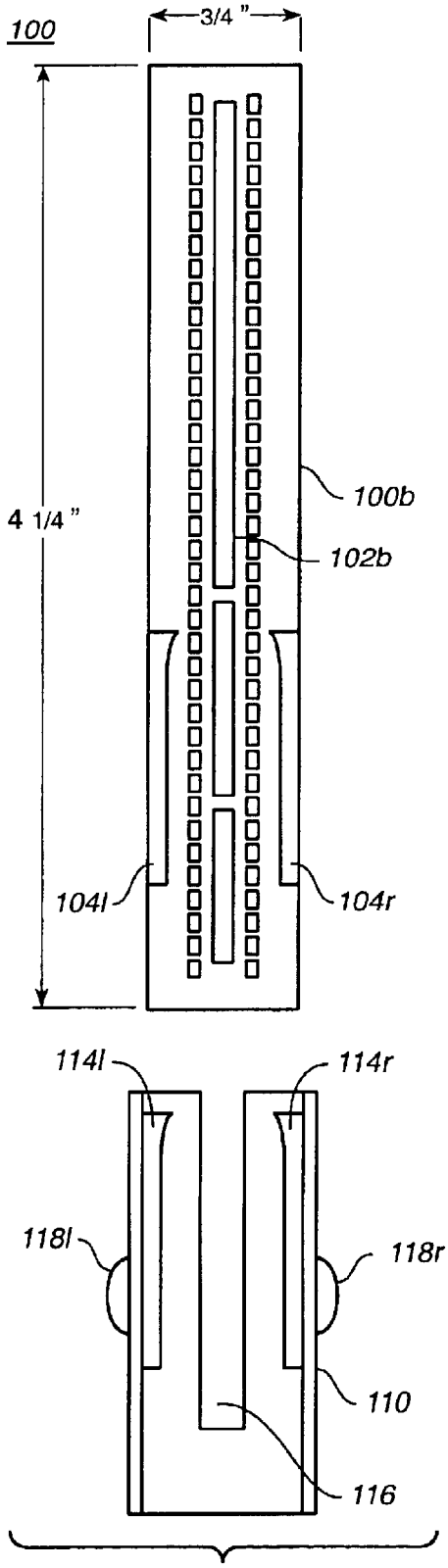
FIG. 4C is an illustration of an alternatively sized bus slot connector slot shown having a retention device moveably coupled therewith, in accordance with one embodiment of the present invention.
Figure 4D:
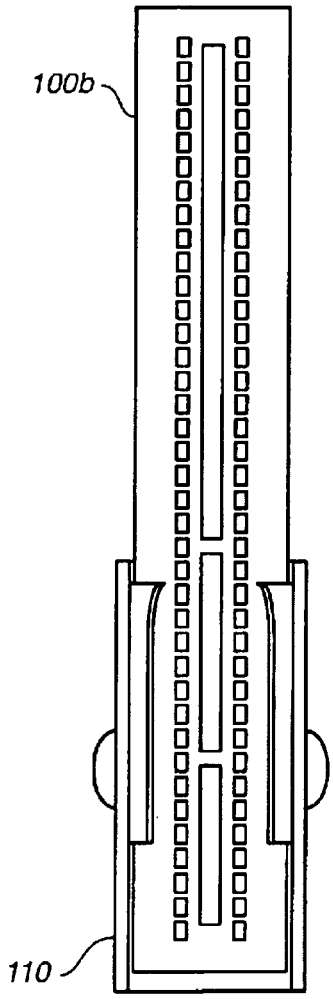
FIG. 4D is an illustration of the alternatively sized bus slot connector of FIG. 4C with the retention device in a closed or locking position, in accordance with one embodiment of the present invention.

FIG. 4A and FIG. 4B is an illustration of a bus slot connector system 100 for retaining adapter cards received therein, in one embodiment of the present invention. In FIG. 4A, shown are a bus slot connector 100*a* and a retention device, e.g., slide clip 110, in one embodiment of the present invention. In one embodiment, bus slot connector 100*a* is shown having an external width of three-quarters of an inch and an external length of two and seven-eighths inches. In the present embodiment, bus slot connector 100*a* of FIGS. 4A, 4B, 4G, and FIGS. 5A–5D is a standard AGP (accelerated graphics port) connector. In another embodiment, bus slot connector can have alternative external dimensions, e.g., bus slot connector 100*b*, as shown in FIGS. 4C and 4D. It is also noted that bus slot connector 100*a* and slide clip 110 can have alternative dimensions for utilization in alternative implementations including, but not limited to, system memory connectors, communication connectors, and the like.

Still referring to FIG. 4A, bus slot connector 100*a* is shown having a receiving portion 102*a*, in one embodiment. Receiving portion 102*a* is adapted to receive a connector portion of an adapter card e.g., connector portion 33 of a graphics adapter card 30 of FIG. 4G. Disposed within bus slot connector 100*a* are a connector for communicative and electronic coupling with a motherboard 600, e.g., connector 105P and a connector 105A, coupled with connector 105P, and adapted to provide communicative and electronic coupling of a connector portion 33 of an adapter card 30 with a bus of motherboard, e.g., bus 608 of motherboard 600. In one embodiment, bus slot connector 100*a* is shown having a plurality of slide rail channels, e.g., slide rail channel 104*l* and 104*r*, that are disposed on opposing sides (left and right sides, respectively) of bus slot connector 100*a*.

Shown also in FIG. 4A is a retention device, slide clip 110, in one embodiment of the present invention. In the present embodiment, slide clip 110 is coupled with a bus slot connector 100*a*, although to more clearly describe slide clip 110, it is shown separate from bus slot connector 110*a*. Slide clip 110 is, in one embodiment, adapted to be moveably coupled with and slidable along bus slot connector 100*a*. Accordingly, slide clip 110 has an internal dimension slightly larger than an outer dimension of a bus slot connector, e.g., bus slot connector 100*a* or 100*b*, enabling sliding of a slide clip 110 along bus slot connector 100. Slide clip 110 is, in one embodiment, shown having a slot 116 disposed on a top surface thereof. In one embodiment, slot 116 is slightly wider than a tab 32 of adapter card 30 (FIG. 4G), enabling slide clip 110 to slide along bus slot connector 110*a* and enabling slot 16 of slide clip 110 to engage tab 32 of adapter card 30, thus retaining an adapter card 30 (FIG. 4G) having a connector portion 33 inserted in slot 102*a*.

Still referring to FIG. 4A, slide clip 110 is also shown having plurality of slide rail keys, e.g., slide rails 114*l* and 114*r*. Slide rails 114*l* and 114*r* are, in one embodiment, disposed on opposing internal surfaces of slide clip 110, also shown in FIG. 4G. Slide rails 114*l* and 114*r* are configured to mate with and be disposed within slide rail channels 104*l* and 104*r* of bus slot connector 100*a*, as shown in FIG. 4B.

Slide clip 110 of FIG. 4A also shows a finger gripping structure 118*l* and 118*r* which, in one embodiment, are disposed upon opposing external surfaces of slide clip 110 and are adapted to facilitate sliding of slide clip 110 along bus slot connector 100*a*. In this example, finger gripping structures 118*l* and 118*r* are rounded in shape, although alternative shapes can be implemented, e.g., rectangular, elliptical, etc. It is noted that many alternatively shaped finger gripper structures can be implemented.

It is further noted that, in one embodiment, slide rails 114*l* and 114*r* and slide rail channels 104*l* and 104*r* are tapered, meaning there is one end that is wider/deeper than the other, as shown in FIGS. 4A–4D. Having one end tapered provides positive positioning of slide clip 110 in a lock position, as shown in FIG. 4B as well as preventing decoupling of slide clip 110 when in an open position, as shown in FIG. 4F.

FIG. 4B is an illustration of bus slot connector 100*a* and slide clip 110 which shows slide clip 110 in a lock position, in one embodiment. When in a lock position, slide clip 110 prevents loosening and/or dislodging of a connector portion 33 of an adapter card 30 when inserted therein. In the present embodiment, bus slot connector 100*a* is configured to have connector portion 33 of adapter card 30 disposed within receiving slot 102*a* while tab 32 is positioned outside receiving slot 102*a*. Accordingly, opening 116*a* would have tab 32 of adapter card 30 disposed therein.

FIG. 4C and FIG. 4D is another illustration of a bus slot connector system 100 for retaining adapter cards received therein. In FIG. 4C, shown are a bus slot connector 100*b* and a retention device, e.g., slide clip 110, in one embodiment of the present invention. In one embodiment, bus slot connector 100*b* is shown having an external width of three-quarters of an inch and an external length of four and one-quarter inches. In the present embodiment, bus slot connector 100*b* of FIGS. 4C and 4D is a professional AGP (accelerated graphics port) connector. It is also noted that bus slot connector 100*b* and slide clip 110 can have alternative dimensions for utilization in alternative implementations including, but not limited to, system memory connectors, communication connectors, and the like.

A receiving slot 102*b* is disposed within bus slot connector 100*b*, in one embodiment of the present invention. Slide rail channels 104*l* and 104*r* are also shown, analogous to slide rail channels 104*l* and 104*r* of FIGS. 4A and 4B.

Slide clip 110 of FIGS. 4C and 4D is analogous to slide clip 110 of FIGS. 4A and 4B. By virtue of bus slot connector 100*b* of FIGS. 4C and 4D being longer than bus slot connector of FIGS. 4A and 4B, in the present embodiment tab 32 of adapter card 30 is disposed within a portion of receiving slot 102*b* when an adapter card 30 is inserted therein.

FIG. 4E is an illustration of a bus slot connector, e.g., bus slot connector 100*a* and a retention device, e.g., slide clip 110, in one embodiment of the present invention. In this illustration, slide clip 110 is shown in a lock position, preventing loosening or dislodging of an adapter card 30 inserted therein. It is noted that slide clip 110 also prevents removal or insertion of a connector portion 33 of an adapter card 30 into receiving slot 102*a* when in a lock position.

FIG. 4F is an illustration of bus slot connector 100*a* and slide clip 110*a* of FIG. 4E in an open position. By virtue of the tapering of both slide rails, 114*l* and 114*r*, and both slide rail channels, 104*l* and 104*r*, slide clip 110 is prevented from being separated from bus slot connector 100*a*. In another embodiment, slide clip 110 can be configured to be removeably coupled with alternative bus slot connectors, e.g., memory bus slots, communication bus slots, and the like.

FIG. 4G is an illustration of a bus slot connector 110*a*, a slide clip 110*b*, and an adapter card 30, in an implementation of one embodiment of the present invention. Slide clip 110*b* is functionally analogous to slide clip 110 of FIGS. 4A–4F. Adapter card 30 is shown having a connector portion 33, a tab 32, and an opening 31. Connector portion 33 of adapter card 30 is adapted to be inserted in a receiving slot 102*a* of bus slot connector 100*a*, as indicated by arrow 29, and to interface with connector 105A of bus slot connector 100*a*, as shown in FIG. 6.

Also shown is bus slot connector 100*a*. Bus slot connector 100*a* is analogous to bus slot connector 100*a* of FIGS. 4A and 4B. Slide clip 110*b* is also shown. In this embodiment, slide clip 110*b* is configured with finger gripper structures 118*l–b* and 118*r–b*, although by virtue of the viewing angle, finger gripper structure 118*r–b* is not visible. In this implementation, finger gripper structures 118*l–b* and 118*r–b* are ridges that extend outward from opposing sides of slide clip 110*b*. In another implementation, finger gripper structures 118*l–b* and 118*r–b* can be trenches that are cut into opposing sides of slide clip 110*b*. Also shown on slide clip 110*b* is slide rail 114*r* (shown,) which along with slide rail 114*l*, (not shown by virtue of the viewing angle), are, in one embodiment, are disposed upon internal opposing surfaces of slide clip 110. Slot 116 of slide clip 110*b* is configured to slide around tab 32 of adapter card 30 when slide clip 110*b* is in a lock position, as indicated by arrow 200.

Referring collectively to FIGS. 5A–5D, shown is a chronological pictogram illustrating a process of inserting an adapter card, e.g., adapter card 30, into a bus slot connector, e.g., bus slot connector 100*a* and retaining the inserted card through utilization of the retentive functionality provided by embodiments of the present invention.

Figure 5A:
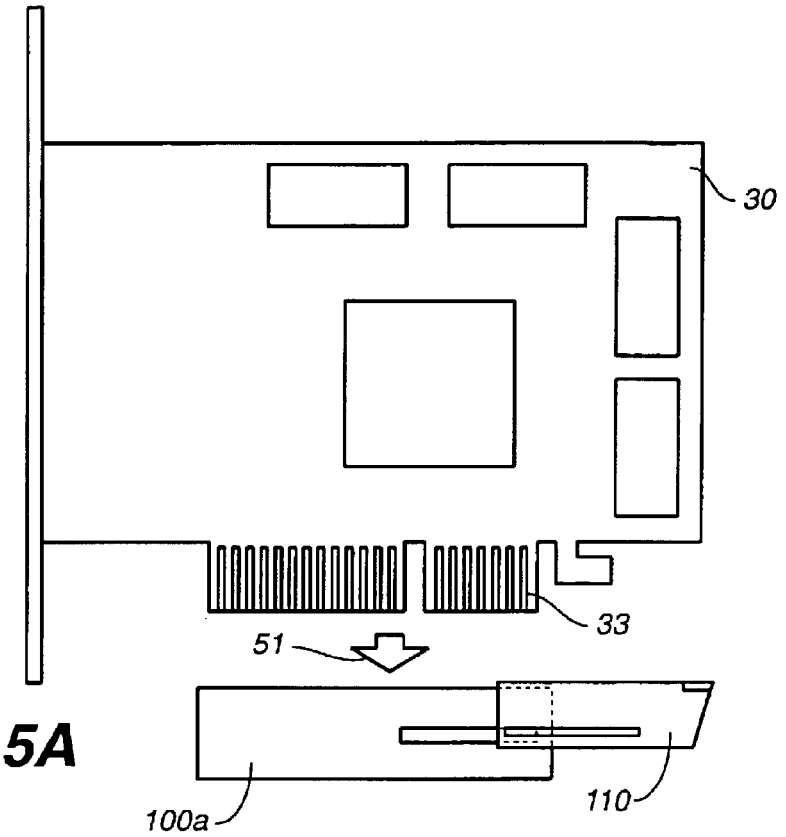
FIG. 5A is an illustrated of a bus slot connector with a retention device moveably coupled therewith and in an open position, allowing an adapter card to be inserted into the bus slot connector, in accordance with one embodiment of the present invention.

FIG. 5A shows bus slot connector 100*a* with a movably coupled slide clip 110 in an open position, in one embodiment of the present invention. FIG. 5A shows that by virtue of slide clip 110 in an open position, connector portion 33 of adapter card 30 can be inserted in receiving slot 102*a* (not visible by virtue of viewing angle) of bus slot connector 100*a*, as indicated by arrow 51.

Figure 5B:
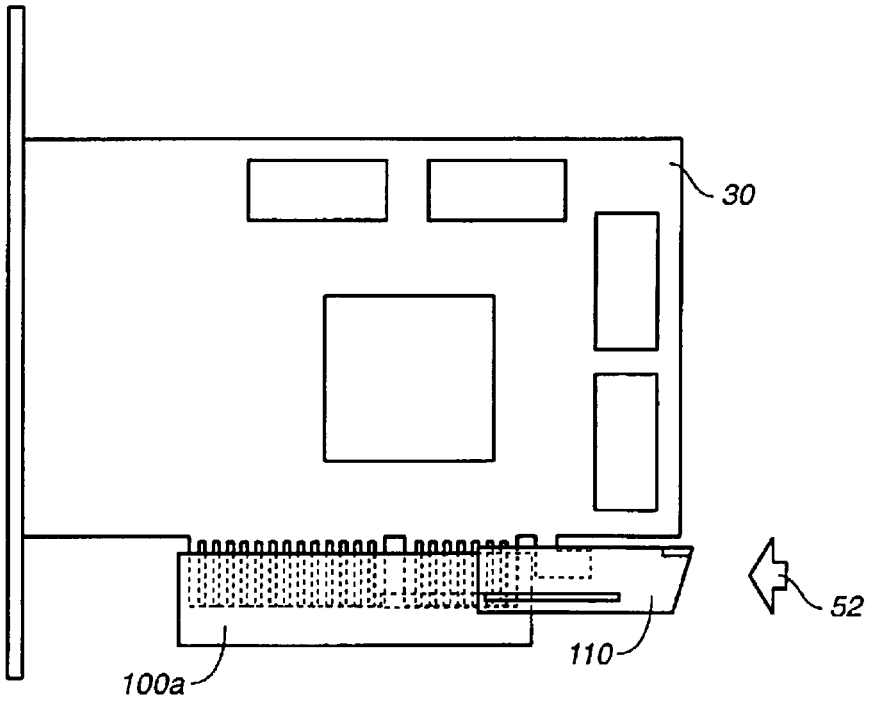
FIG. 5B is a sequential illustration of FIG. 5A showing an adapter card inserted in a bus slot connector with the retention device of the bus slot connector in an opened position, in accordance with one embodiment of the present invention.

FIG. 5B is a chronological illustration of FIG. 5A subsequent to insertion of connector portion 33 of adapter card 30 into receiving slot 102*a*, in one embodiment of the present invention. Slide clip 110 is shown still in an open position, prior to moving slide clip 110 into a lock position, as indicated by arrow 52. An inserted adapter card 30 can become loosened or dislodged while slide clip 110 is in an open position.

Figure 5C:
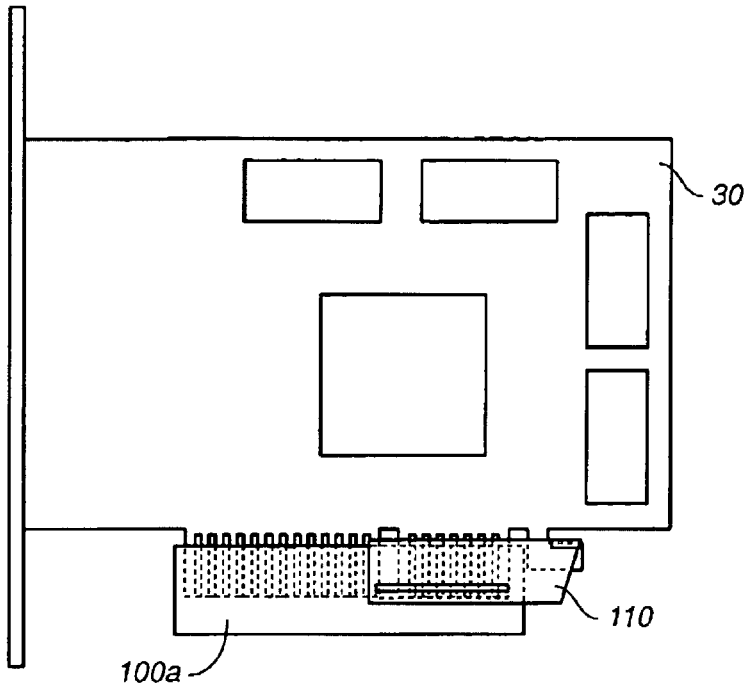
FIG. 5C is a sequential illustration of FIG. 5B showing the retention device of the bus slot connector in a closed or locking position, thus preventing loosening or dislodging of the adapter card inserted therein, in accordance with one embodiment of the present invention.

FIG. 5C is a chronological illustration of slide clip 110 subsequent to being moved to a lock position, in one embodiment of the present invention. By virtue of slide clip 110 in a lock position, adapter card 30 is prevented from becoming loosened or dislodged, thus connector portion 33 remains properly disposed within receiving slot 102*a*.

Figure 5D:
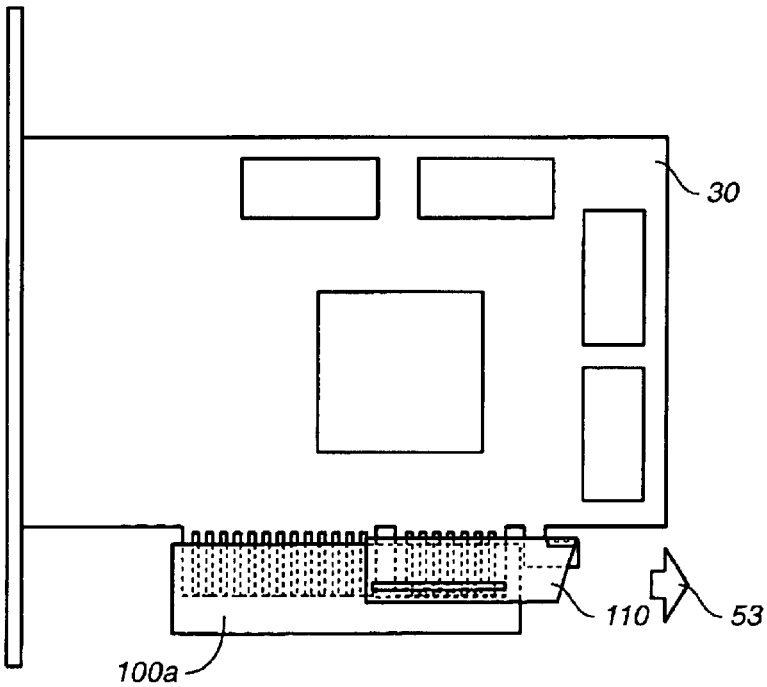
FIG. 5D is a sequential illustration of FIG. 5C showing the retention device moveable from a locking position to an open position allowing removable of an inserted adapter card, in accordance with one embodiment of the present invention.

FIG. 5D is an illustration of adapter card 30, bus slot connector 100*a*, and slide clip 110, prior to removal of connector portion 33 from receiving slot 102*a*. It is noted that until slide clip 110 is moved to an open position, as indicated by arrow 53, removal of adapter card 30 is prevented.

FIG. 6 is a block diagram of a printed circuit board, e.g., motherboard 600, upon which bus slot connector system 100 of FIGS. 4A–4G can be implemented, in one embodiment of the present invention. It is noted that bus slot connector system 100 can be implemented on alternative printed circuit boards including, but not limited to, motherboards.

FIG. 6 is a functional block diagram of components and circuitry which can be implemented on a printed circuit board, e.g., MB (motherboard) 600. MB 600 includes an address/data bus 608 for communicating information, a central processor 601 coupled with the bus for processing information and instructions, a volatile memory 602 (e.g., random access memory, RAM) coupled with the bus 608 for storing information and instructions for the central processor 601 and a non-volatile memory 603 (e.g., read only memory, ROM) coupled MB 600 also includes an optional data storage device 604 (e.g., hard disk drive) coupled with the bus 608 for storing information and instructions. Device 604 can be removable. In another embodiment, bus 608 can be nearly any type of bus structure and/or connectivity mechanism.

With reference still to FIG. 6, MB 600 also includes an optional alphanumeric input device 606 that in one implementation is a keyboard. Alphanumeric input device 606 can communicate information and command selections to processor 601. MB 600 also includes an optional cursor control or directing device 607 coupled to bus 608 for communicating user input information and command selections to processor 601. In one implementation, on-screen cursor control device 607 is a mouse.

Still referring to FIG. 6, MB 600 also has a bus slot connector 100 mountably coupled therewith. Bus slot connector 100 is shown having a connector 105P and a connector 105A. As described above, connector 105P and 105A are, in one embodiment, disposed within bus slot connector 100. Bus slot connector 100 is adapted to be communicatively and electronically coupled with bus 608 of MB 600. In one embodiment, bus slot connector 100 is soldered to motherboard 600, although alternative methods of mounting can be utilized, e.g., receiving sockets, and the like. Connector 105P provides communicative and electronic coupling of bus slot connector 100 to bus 608. Connector 105A is communicatively and electronically coupled with connector 105P and provides communicative and electronic coupling of a connector portion 33 of an adapter card 30 (FIG. 4G) to connector 105P.

An optional display device 605 can be coupled with bus 608 via coupling with adapter card 30 which is coupled with bus slot connector 100, in one embodiment of the present invention. Display device 605 is for displaying information to a computer user. Display device 605 may be a liquid crystal display (LCD), a cathode ray tube (CRT), a flat panel display such as an FED (field emission display), an electronic paper display, or nearly any other display device suitable for creating and generating graphic images and alphanumeric characters recognizable to a user.

Figure 7:
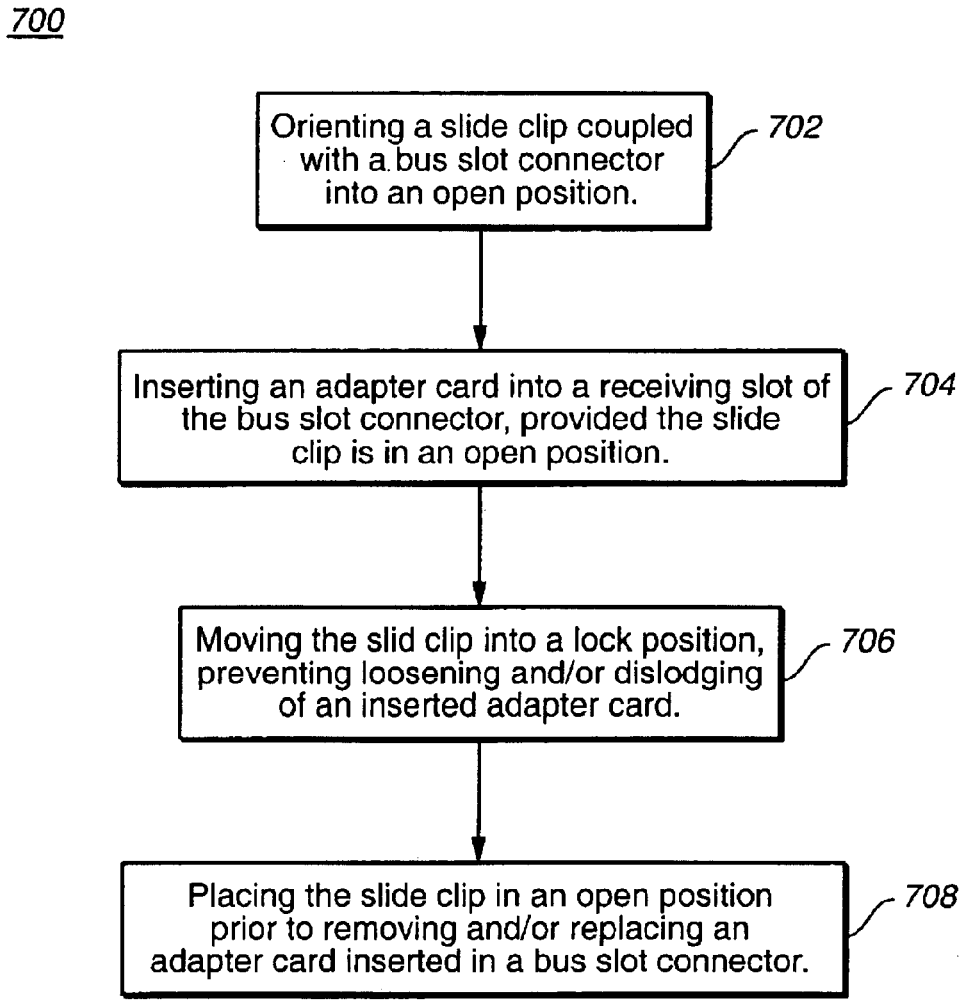
FIG. 7 is a flowchart of a process of retaining an adapter card inserted in bus slot connector having a retention device moveably coupled therewith, in accordance with one embodiment of the present invention.

FIG. 7 is a flowchart 700 of steps performed in accordance with one embodiment of the present invention for utilizing a bus slot connector system to retain adapter cards inserted therein. Flowchart 700 includes processes of the present invention which, in one embodiment, are carried out by a user. Although specific steps are disclosed in flowchart 700, such steps are exemplary. That is, the present invention is well suited to performing various other steps or variations of the steps recited in FIG. 7. Within the present embodiment, it should be appreciated that the steps of flowchart 700 may be performed by a computer support technician, by a computer consumer/user, or by many other individuals or groups of individuals striving to maintain proper connectivity of an adapter card inserted in a bus slot connector.

In step 702 of FIG. 7, slide clip 110 is in or has been moved to an open position, as shown in FIG. 5A. By placing slide clip 110 is an open position, a connector portion 33 of adapter card 30 can be inserted in receiving slot 102*a* of bus slot connector 100*a* or 100*b*.

In step 704 of FIG. 7, a connector portion 33 of adapter card 30 has been inserted in receiving slot 102*a* of bus slot connector 102*a*, in one embodiment, as shown in FIG. 5B. Subsequent to the insertion of portion 33 into receiving slot 102*a*, slide clip 110 is then moved to a lock position, as shown in FIG. 5C.

In step 706 of FIG. 7, slide clip 10 is in a lock position, as shown in FIG. 5C. By virtue of slide clip 110 in a lock position, connector portion 33 of adapter card 30 is prevented from becoming loosened or dislodged from receiving slot 102*a* of bus slot connector 100*a*.

In step 708 of FIG. 7, to remove or replace an adapter card 30 inserted in receiving slot 102*a* of bus slot connector 100*a*, prior repositioning of slide clip 110 to an open position is mandated, as indicated by arrow 53.

Advantageously, embodiments of the present invention provide a bus slot connector system that provides protection against loosening or dislodging of adapter cards inserted therein. Embodiments of the present invention further provide for an easily and readily activated retention device to properly retain an adapter card in a bus slot connector. Additionally, embodiments of the present invention can provide a reduction in warranty return work, thus realizing increased profitability while reducing customer dissatisfaction. Embodiments of the present invention are also well suited to provide decreased assembly time when compared with conventional retention mechanisms.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A bus slot connector comprising:

a housing;

a slot disposed within said housing, said slot adapted to receive a connector portion of an adapter card; and a retention mechanism moveably coupled to and slidable along a tapered portion of said housing, said retention mechanism having a lock position and an open position, said retention mechanism preventing removal of an adapter card inserted in said slot when in said lock position, said retention mechanism permitting insertion of said connector portion of said adapter card into said slot and permitting the removal of said connector portion of said adapter card from said slot when said retention mechanism is in said open position.

2. The bus slot connector of claim 1 wherein said housing further comprises a slide rail channel disposed on an external surface of said housing, said slide rail channel adapted to receive a slide rail disposed upon said retention mechanism.

3. The bus slot connector of claim 1 wherein said retention mechanism further comprises a slide rail adapted to be received in a slide rail channel disposed on said housing.

4. The bus slot connector of claim 1 wherein said retention mechanism further comprises a gripper structure disposed on an external surface of said retention mechanism, said gripper structure adapted to provide digit traction for sliding said retention mechanism from said open position to said lock position and vice versa.

5. The bus slot connector of claim 1 further comprising a connector interface disposed within said housing and comprising a first connector portion and a second connector portion.

6. The bus slot connector of claim 5 wherein said first connector portion is adapted to be contacted by said connector portion of said adapter card when said connector portion is inserted in said slot.

7. The bus slot connector of claim 5 wherein said second connector portion is adapted to be communicatively and electronically coupled with a printed circuit board upon which said housing is adapted to be mountably coupled.

8. The bus slot connector of claim 1 wherein said adapter card is a graphics adapter card.

9. The bus slot connector of claim 8 wherein said graphics adapter card is an accelerated graphics port adapter card.

10. A bus slot connector system comprising:

receiving means for receiving a connector means of an adapter card, said receiving means disposed within a housing; and retention means for retaining said received connector means of an adapter card, said retention means moveably coupled with said housing means and slidable along a tapered portion of said housing means, said retention means having an open position means and a lock position means, wherein said retention means is adapted to prevent removal of said connector means in said receiving means when said retention means is in a lock position and wherein said retention means is adapted to permit insertion and removal of said connector means when said retention means is in an open position.

11. The bus slot connector system of claim 10 further comprising: first connector means adapted to be contacted by said connector means of said adapter card when said connector means is received in said receiving means, said first connector means disposed within said housing means.

12. The bus slot connector system of claim 10 further comprising: second connector means coupled with said housing and communicatively and electronically coupled with said first connector means, said second connector means adapted to be communicatively and electronically coupled to a printed circuit board upon which said housing means is adapted to be mountably coupled.

13. The bus slot connector system of claim 10 wherein said housing means further comprises a slide rail channel means eternally disposed thereon, said slide rail channel means for receiving a slide rail means disposed upon said retention means.

14. The bus slot connector system of claim 10 wherein said retention means further comprises a slide rail means adapted to be received by a slide rail channel means disposed upon said housing means.

15. The bus slot connector system of claim 10 further comprising: gripping means externally disposed upon said retention means, said gripping means adapted to provide digit adhesion functionality to said retention means, said gripping means facilitating moving said retention means from said open position to said lock position, and vice versa.

16. A method for retaining an adapter card in a bus slot connector comprising:

positioning a retention mechanism in an open position relative to a receiving slot disposed in bus slot connector, said retention mechanism movably coupled with and slidable along said bus slot connector;

receiving a connector portion of an adapter card into said receiving slot of said bus slot connector; and moving said retention mechanism from said open position to a lock position along a tapered path, said lock position preventing removal of said connector portion of said adapter card from said receiving slot of said bus slot connector.

17. The method as recited in claim 16 further comprising: repositioning said retention mechanism to said open position to permit removal of said connector portion of said adapter card from said receiving slot.

18. The method as recited in claim 16 wherein said adapter card is a graphics adapter card.

19. The method as recited in claim 18 wherein said graphics adapter card is an accelerated graphics port adapter card.

* * * * *